US007228882B2

(12) United States Patent
Marschand et al.

(10) Patent No.: US 7,228,882 B2
(45) Date of Patent: Jun. 12, 2007

(54) TAPE DISPENSER WITH A CUSHIONED APPLICATOR TIP

(75) Inventors: Bret R. Marschand, Glendale Heights, IL (US); Andrew Bielecki, Evanston, IL (US)

(73) Assignee: Sanford, L.P., Oak Brook, IL (US)

( * ) Notice: Subject to any disclaimer, the term of this patent is extended or adjusted under 35 U.S.C. 154(b) by 333 days.

(21) Appl. No.: 10/662,851

(22) Filed: Sep. 15, 2003

(65) Prior Publication Data

US 2005/0056374 A1 Mar. 17, 2005

(51) Int. Cl.
*B32B 37/22* (2006.01)

(52) U.S. Cl. ..... 156/523; 156/577; 156/579; 118/76; 118/200; 118/257; 242/588.2; 242/588.3; 242/588.6; 242/588; 242/160.2; 242/160.4; 242/170; 242/171; 206/411

(58) Field of Classification Search ..... 156/523, 156/577, 579, 574, 527, 238, 538, 540; 118/76, 118/200, 257; 206/411; 242/170, 171, 588.2, 242/588.3, 588.6, 588, 160.2, 160.4
See application file for complete search history.

(56) References Cited

U.S. PATENT DOCUMENTS

| | | | | |
|---|---|---|---|---|
| 4,851,076 A | | 7/1989 | Manusch et al. | 156/577 |
| 5,009,739 A | * | 4/1991 | Goodwin et al. | 156/384 |
| 5,772,840 A | * | 6/1998 | Morinaga | 156/540 |
| 6,079,660 A | * | 6/2000 | Manusch et al. | 242/538.1 |
| 6,273,169 B1 | | 8/2001 | Ono et al. | 156/540 |
| 6,453,968 B1 | * | 9/2002 | Hsu | 156/577 |
| 6,681,830 B1 | * | 1/2004 | Vulpitta et al. | 156/527 |
| 6,732,781 B2 | * | 5/2004 | Bouveresse | 156/577 |
| 6,796,355 B2 | * | 9/2004 | Huthmacher et al. | 156/577 |
| 2004/0033353 A1 | * | 2/2004 | You | 428/343 |

FOREIGN PATENT DOCUMENTS

| | | |
|---|---|---|
| EP | 267 396 A1 | 5/1988 |
| EP | 0 427 870 A1 | 5/1991 |

(Continued)

OTHER PUBLICATIONS

PCT International Written Opinion issued in PCT/US2004/06382, mailed Jul. 22, 2004.
PCT International Search Report issued in PCT/US2004/06382, mailed Jul. 22, 2004.

*Primary Examiner*—Mark A. Osele
(74) *Attorney, Agent, or Firm*—Marshall, Gerstein & Borun LLP

(57) ABSTRACT

A transfer tape dispenser includes a case, a supply spool, a return spool, and a substantially rigid applicator tip having an application edge. The applicator tip is disposed in a path of a transfer tape that originates from the supply spool and terminates at the return spool. When pressing the application edge on a surface, an application layer of the transfer tape adheres to the surface. The transfer tape dispenser includes a cushion that cushions the pressing of the application edge on the surface. The transfer tape dispenser further includes a slip clutch mechanism for providing slipping of the supply spool relative to the rotation of the return spool, when necessary, to maintain a desired tension in the correction transfer tape.

31 Claims, 5 Drawing Sheets

FOREIGN PATENT DOCUMENTS

| | | | | |
|---|---|---|---|---|
| EP | 1 295 834 | A1 | | 3/2003 |
| JP | 09002724 | A | * | 1/1997 |
| JP | 2000238957 | A | * | 9/2000 |
| JP | 2001 010290 | A | | 1/2001 |
| JP | 2003103994 | A | * | 4/2003 |
| WO | WO 0162648 | A1 | * | 8/2001 |

* cited by examiner

TAPE DISPENSER WITH A CUSHIONED APPLICATOR TIP

FIELD OF DISCLOSURE

This disclosure is related generally to transfer tape dispensers, and more particularly, to a transfer tape dispenser with a cushioned applicator tip.

BACKGROUND

Transfer tape dispensers are typically used to apply an application layer of material to a surface from a flexible carrier tape. The dispensers typically include an applicator tip that receives the carrier tape coated on one side with the application layer from a supply spool and apply the application layer to a surface. A return spool then collects the carrier tape.

The application layer can consist of one or more layers of material. What characterizes the application layer is when pressed to a surface by the applicator tip it is released from the carrier tape and transferred to the surface. A correction application layer consists of an opaque layer to obscure a mark and a contact adhesive layer to attach the opaque layer to a surface.

The applicator tip of a typical correction transfer tape dispenser is constructed from a flexible material or shaped to bend when pressed on a surface. Accordingly, the applicator tip can bend to align itself with the surface when being pressed thereon. Furthermore, the flexibility of the applicator tip provides a user with feedback regarding the amount of pressure to place on the applicator tip for application of the correction tape layer to the surface.

Correction transfer tape dispensers that have a highly flexible applicator tip are susceptible to the problem of the applicator tip deforming permanently from repeated use. In contrast, some correction transfer tape dispensers have applicator tips that do not deform sufficiently when pressed on a surface. This may result in the correction tape layer not properly adhering to the surface, or the user not being able to determine adequate pressure to apply to the surface.

DETAILED DESCRIPTION

Figures 1, 7:
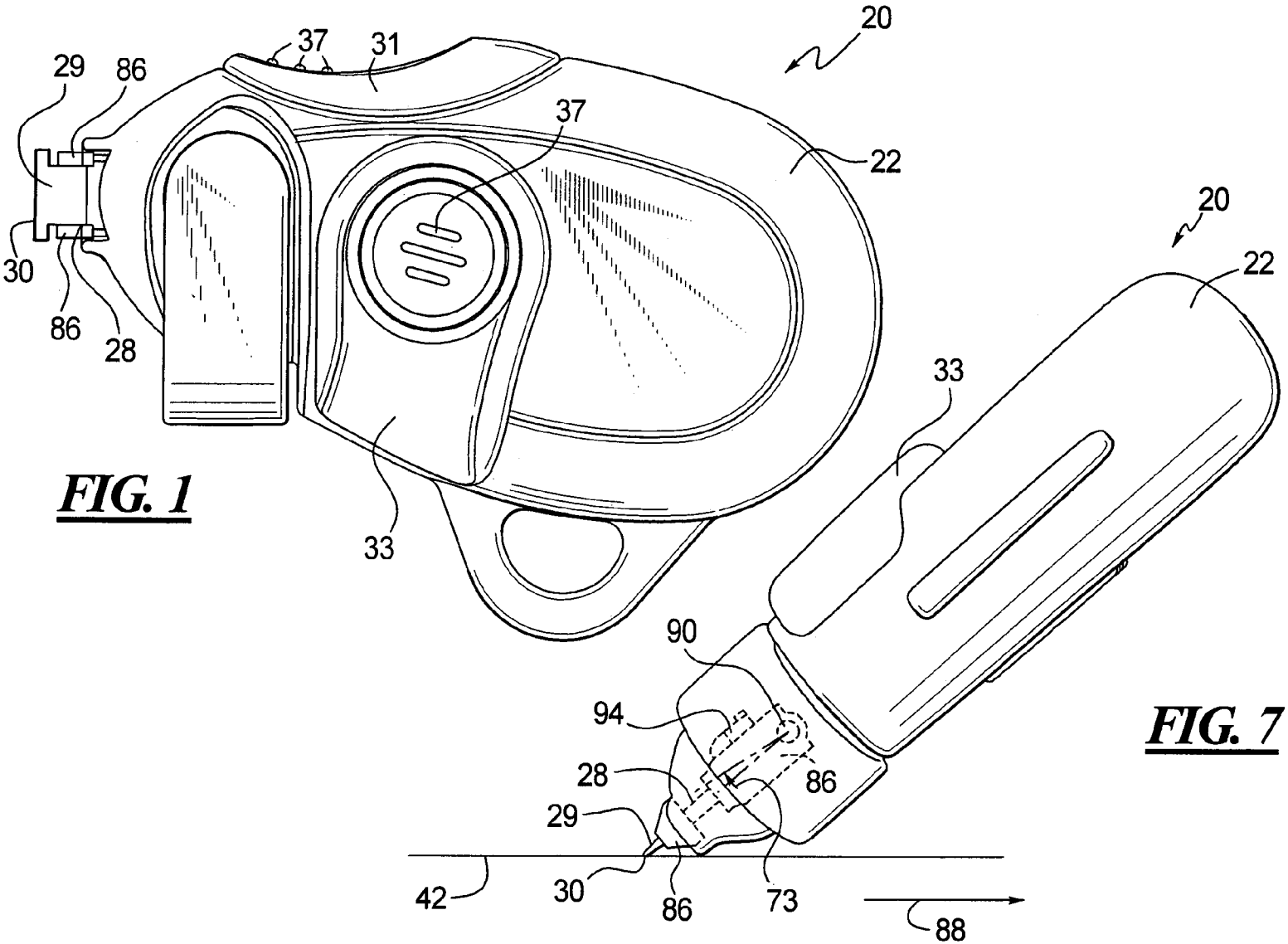
FIG. 1 is a side elevational view of a transfer tape dispenser constructed in accordance with the teachings of the present disclosure.
FIG. 7 is a bottom elevational view of a transfer tape dispenser constructed in accordance with the teachings of the present disclosure.

Referring to FIGS. 1–8, a transfer tape dispenser 20 in accordance with the teachings of the present disclosure is generally shown. The transfer tape dispenser 20 includes a case 22, a supply spool 24, a return spool 26, and an applicator tip 28 having an application edge 30. The transfer tape dispenser 20 also includes a correction tape 32 having an application layer (not shown) and a carrier tape (not shown). A path of travel of the transfer tape 32 in the transfer tape dispenser 20 originates with the supply spool 24 and terminates with the return spool 26. A tape post 38 directs the transfer tape 32 from the supply spool 24 to the applicator tip 28, and from the applicator tip 28 to the return spool 26, respectively. When pressing the application edge 30 on a surface 42 (as shown in FIG. 7), the application layer (not shown) adheres to the surface 42 to mask a portion of the surface 42 to which it is applied. Subsequently, the carrier tape (not shown) is collected by the return spool 26. The transfer tape dispenser 20 includes a cushion body 94 that cushions the pressing of the application edge 30 on the surface 42. The transfer tape dispenser 20 further includes a slip clutch mechanism 46 for providing slipping of the supply spool 24 relative to the rotation of the return spool 26, when necessary, to avoid the buildup of excessive tension in the transfer tape 32.

One of ordinary skill in the art will readily appreciate that the application layer (not shown) of the transfer tape 32 can provide numerous functions. For example, the application layer (not shown) can be an adhesive material, a highlighting material, or a decorative coating material. Accordingly, one side of the application layer (not shown) can adhere to the surface 42, while the other side of the application layer (not shown) can provide a different functionality. In the disclosed example, however, the application layer (not shown) is a correction tape layer and is referred to as such. The correction tape layer (not shown) can be applied to a surface 42 to mask a portion of the surface 42 to which it is applied. The correction tape layer (not shown) is applied to one side of a carrier tape. The carrier tape consists of a flexible ribbon or strip of plastic or paper.

Figure 2:
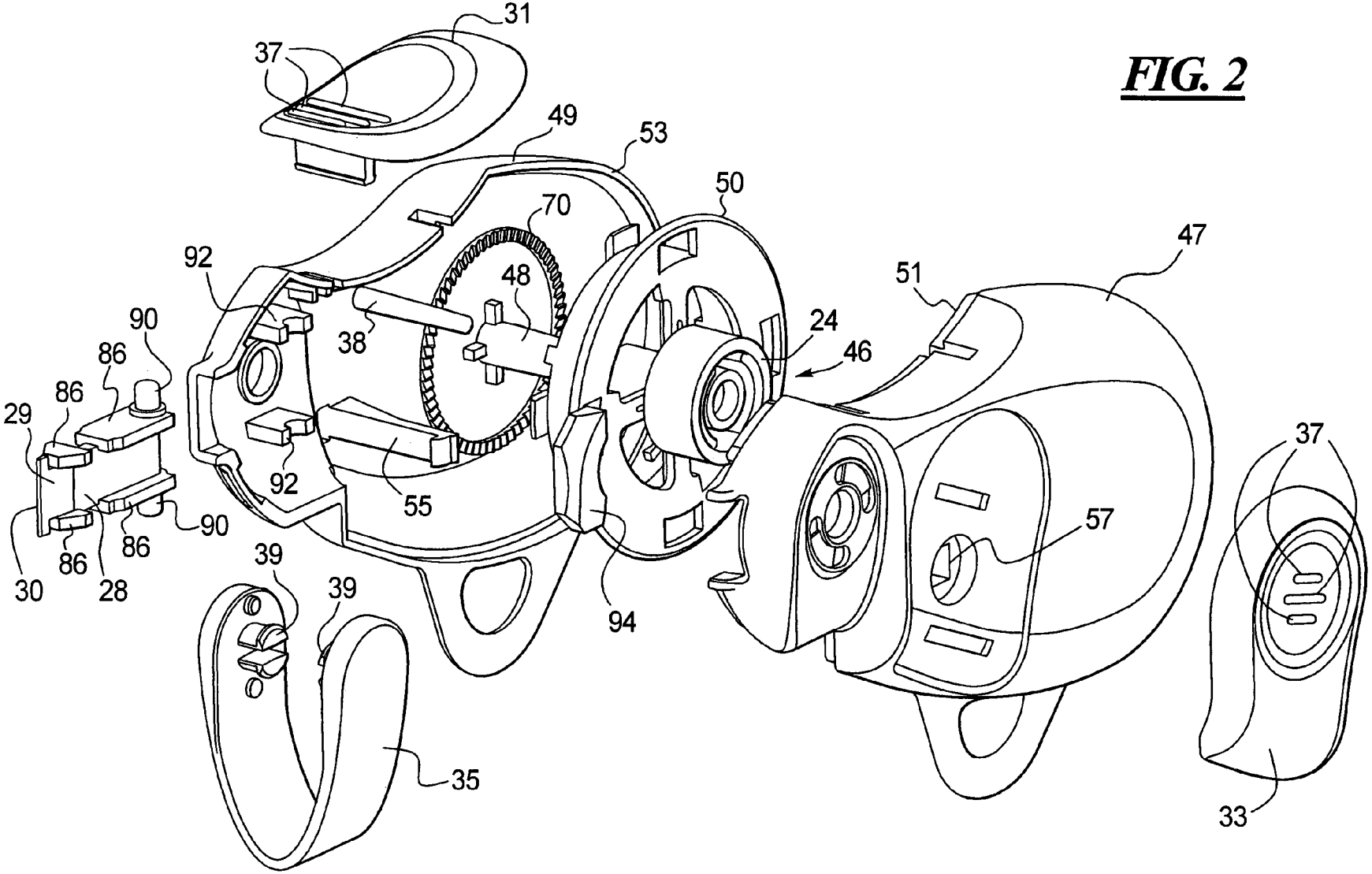
FIG. 2 is an exploded isometric view of a transfer tape dispenser constructed in accordance with the teachings of the present disclosure.

Referring to FIG. 2, the case 22 includes a first side 47 and a second side 49, that are attached together to house various components of the transfer tape dispenser 20. In the disclosed example, the two housings 47 and 49 of the case 22 are detachably attached together by a tongue 51 on the first side 47 that engages a groove 53 on the second side 49. To secure the two housings 47 and 49 together, the second side 49 includes a locking tab 55 that engages a corresponding aperture 57 in the first side 47. The case 22 can be shaped as desired. However, in the disclosed example, the case 22 is ergonomically shaped to provide comfort and intuitive operation when being operated by a user.

Referring to FIGS. 1 and 2, the transfer tape dispenser 20 includes an index finger grip pad 31, a thumb grip pad 33, and an applicator tip cover 35 that is pivotally attached to the case 22. The index finger grip pad 31 is disposed on the upper part of the case 22 where a user would typically place his index finger when using the transfer tape dispenser 20. The grip pads 31 and 33 may be part of the case 22 and constructed from the same material, or be independent grip pads of a different material that are attached to or formed on the case 22. In the disclosed example, the grip pads 31 and 33 are constructed from a soft plastic and are attached to the case 22. Additionally, to provide sufficient grip between a user's finger and the grip pads 31 and 33 when holding the transfer tape dispenser 20, both grip pads 31 and 33 may be constructed from rubber and may include a number of ridges 37 on their respective surfaces.

The application tip cover 35 protects the applicator tip 28 when not in use. Referring to FIG. 2, the applicator tip cover 35 is generally shaped to correspond with the lateral cross sectional profile of the case 22. Each end 39 of the applicator tip cover 35 is pivotally attached to one of the first side 47 or the second side 49 of the case 22. Accordingly, the applicator tip cover 35 rotates about an axis (not shown) passing through the ends 39. When the transfer tape dispenser 20 is being used, the applicator tip cover 35 can be pivoted or rotated to the open position, as shown in FIG. 1. When the transfer tape dispenser 20 is no longer being used, a user can rotate the applicator tip cover 35 in a direction 41 to a closed position (not shown) covering the tip 28. The applicator tip cover 35 guards the applicator tip 28 and the application edge 30, and prevents external objects from coming into contact with the applicator tip 28, the application edge 30, and the transfer tape 32. One of ordinary skill in the art will readily appreciate that the applicator tip 28 can be covered by a wide variety of covers. For example, the transfer tape dispenser 20 can include a cap (not shown) that is shaped similar to the portion of the case 22 where the applicator tip 28 is disposed. A user can place the cap on the corresponding portion of the case 22 to cover the applicator tip 22.

The case 22 includes a shaft 48 for mounting a drive wheel 50 inside the case 22. The drive wheel 50 includes a central hub 52 for being rotationally mounted on the shaft 48. The shaft 48 extends laterally and, in this example, from the second side 49 to first side 47. Accordingly, the drive wheel 50 can freely rotate about the shaft 48, but is prevented from moving or rotating in any other direction. The supply spool 24 is rotationally mounted on a supply side 58 of the drive wheel 50, and as will described in detail below can rotate with the drive wheel 50 or slip relative to the drive wheel 50 when necessary. The return spool 26 is disposed on a return side 60 of the drive wheel 50. In the disclosed example, the return spool 26 is an integral part of the drive wheel 50 and, therefore, rotates with the drive wheel 50. In the disclosed example, the return spool 26 is a circular ledge 62 that is integral with and protrudes outwardly from the return side 60 of the drive wheel 50. The circular ledge 62 is concentric with the drive wheel 50 and has a wider width than the width of the transfer tape 32. Accordingly, the circular ledge 62 defines the return spool 26 for collecting the carrier tape (not shown) of the transfer tape 32 in a winding manner, hence the return spool 26. To prevent the transfer tape 32 from sliding off the circular ledge 62 when being wound thereon, a plurality of side walls 64 are provided around the circular ledge 62 to contain the transfer tape 32 on the return spool 26.

To dispense the transfer tape 32 from the supply spool 24, the drive wheel 50 rotates in a dispensing direction 66 to unwind the transfer tape 32 from the supply spool 24. Additionally, the carrier tape (not shown) is collected on the return spool 26 by being wound thereon when the drive wheel 50 rotates in the dispensing direction 66. Accordingly, the transfer tape 32 is dispensed by unwinding from the top of the supply spool 24 and is collected by being wound on the return spool 26 from the bottom thereof. One of ordinary skill in the art will appreciate, however, that the aforementioned winding and unwinding configuration of the transfer tape 32 can be reversed to achieve the same result.

Figure 4:
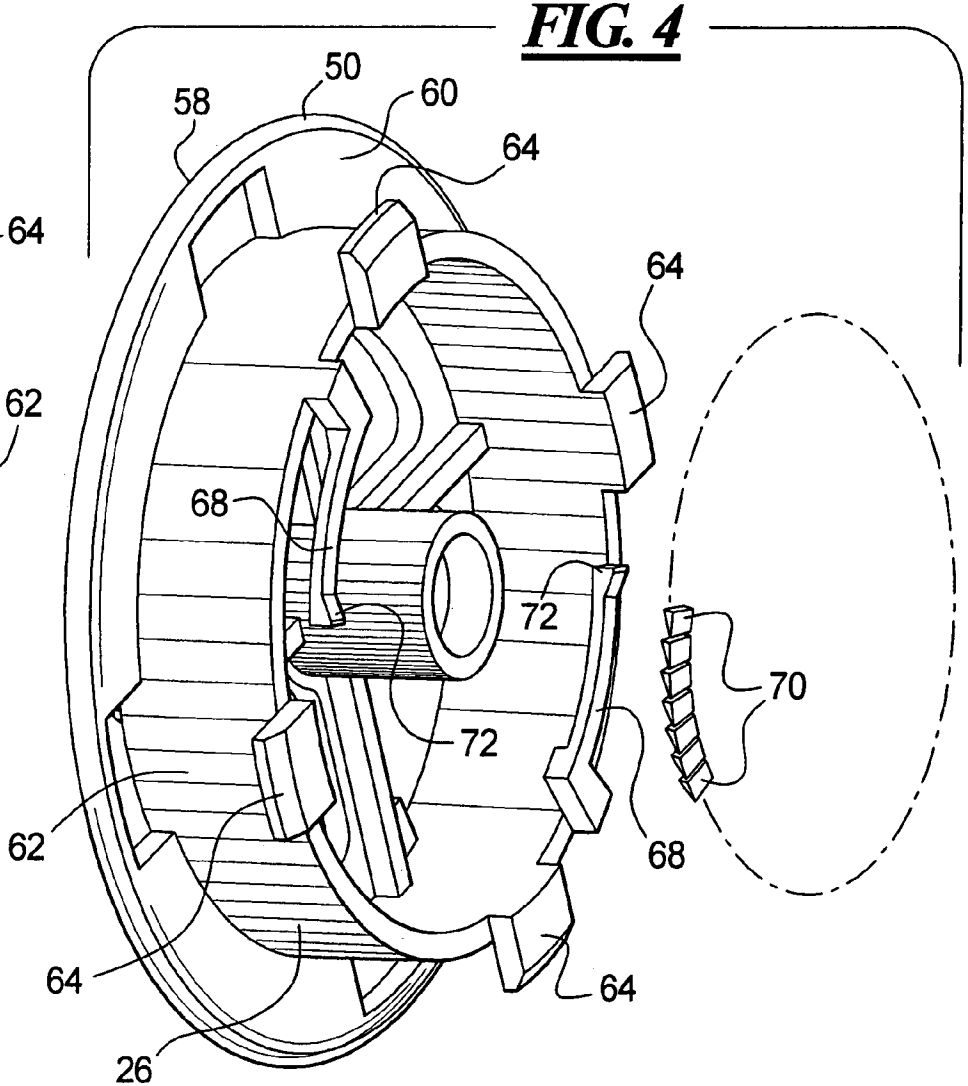
FIG. 4 is an isometric view from the opposite side of the drive wheel of FIG. 3.

To prevent the wheel 50 from rotating in a non-dispensing direction (i.e., opposite the dispensing direction 66), the drive wheel 50 includes a number of flexible tabs 68 radially disposed on the return side 26 of the drive wheel 50 that engage a number of detents 70 radially disposed on the interior of the second side 49. As shown in FIG. 4, the flexible tabs 68 include wedge shaped tips 72 that engage the detents 70, which are also wedge shaped. In the dispensing direction 66, the angled face of each wedge shaped tip 72 engages the angled face of a detent 70. Accordingly, the flexibility of the flexible tabs 68 causes the angled faces of the wedge shaped tips 72 of the flexible tabs 68 to slide over the detents 70 to allow rotation of the drive wheel 50 in the dispensing direction 66. In contrast, when the drive wheel 50 is rotated in the non-dispensing direction, the vertical face of each wedge shaped tip 72 engages the vertical face of a detent 70 to prevent the wheel 50 from rotating in the non-dispensing direction.

As the transfer tape 32 is unwound from the supply spool 24 and wound on the return spool 26, the diameter of the supply spool 24, including the supply of transfer tape 32, shrinks and the diameter of the return spool, including the supply of carrier tape (not shown), grows. Because the two spools 24, 26 generally rotate in unison, the changing diameter would causes tension in the transfer tape 32 to change. The slip clutch mechanism 46 maintains a maximum desired tension in the transfer tape 32 as the diameters of the supply spool 24 and the return spool 26 change.

Figure 3:
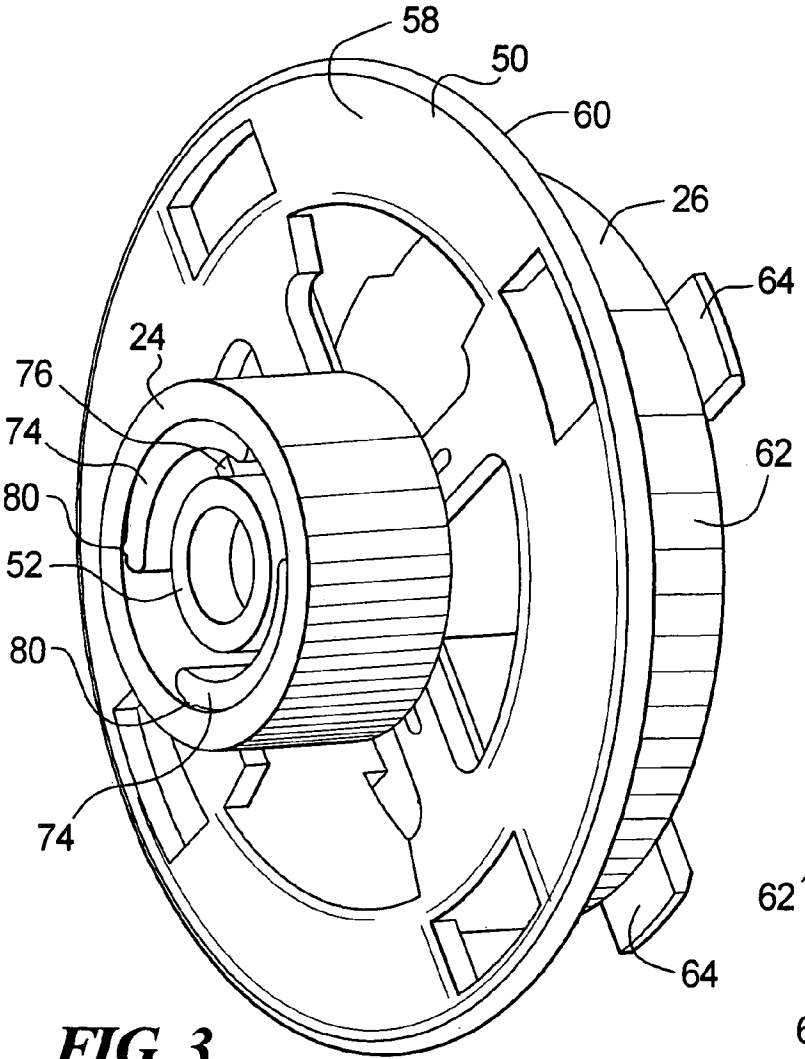
FIG. 3 is an isometric view of a drive wheel of a transfer tape dispenser constructed in accordance with the teachings of the present disclosure.
Figure 5:
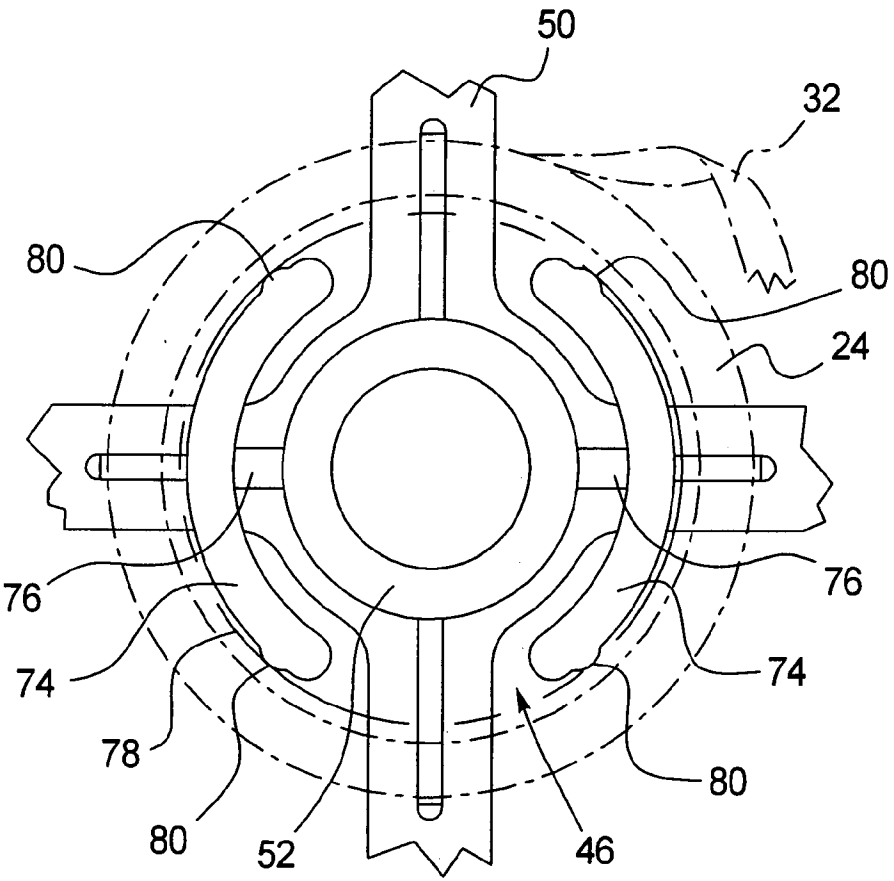
FIG. 5 is a side elevational view of a slip clutch mechanism of a transfer tape dispenser constructed in accordance with the teachings of the present disclosure.

As shown in FIGS. 3 and 5, the slip clutch mechanism 46 includes a pair of arcuate shoes 74 that have an outside diameter of generally similar size as the internal diameter of the supply spool 24. Each arcuate shoe 74 is attached to the hub 52 on the supply side 58 of the drive wheel 50 with a spoke 76. In effect, the arcuate shoes 74 partially define a supply hub 78 (shown with dashed lines), which is concentric with the hub 52, for mounting the supply spool 24 on the supply side 58 of the drive wheel 50. Each arcuate shoe 74 includes a pair of ridges 80 that extend across its width. The ridges 80 slightly protrude radially outward from the supply hub 78. Furthermore, the ridges 80 are distributed relative to the supply hub 78 in an evenly spaced radial manner. Accordingly, when the supply spool 24 is mounted on the supply hub 78, the ridges 80 cause the arcuate shoes 74 to flex and bias the ridges 80 against the internal periphery of the supply spool 24 to maintain frictional contact with the internal periphery of the supply spool 24.

When the diameter of the return spool 26 is larger than the diameter of the supply spool 24, the transfer tape 32 needs to unwind faster from the supply spool 24 than the speed by which is being wound on the return spool 26. The tension of the transfer tape 32 needs to be sufficient to overcome the frictional forces between the ridges 80 and the internal periphery of the supply spool 24 to provide faster rotation of the supply spool 24 relative to the drive wheel 50. Thus, the supply spool 24 must slip on the arcuate shoes 74 when necessary to synchronize the length of tape unwound from the supply spool 24 with the length of the tape wound on the return spool 26.

When the diameter of the return spool 26 is smaller than the diameter of the supply spool 24, the transfer tape 32 needs to unwind slower from the supply spool 24 than the speed by which is being wound on the return spool 26. The tension of the transfer tape 32 needs to be sufficient to overcome the frictional forces between the ridges 80 and the internal periphery of the supply spool 24 to provide slower rotation of the supply spool 24 relative to the drive wheel 50. Thus, the supply spool 24 must slip on the arcuate shoes 74 when necessary to synchronize the length of tape unwound from the supply spool 24 with the length of the tape wound on the return spool 26.

One of ordinary skill in the art will appreciate that the slip clutch mechanism operates by providing a slippable engagement between the drive wheel 50 and the supply spool 24. Accordingly, a variety of well known slip clutch mechanisms can be utilized for the transfer tape dispenser 20. For example, a gasket, an o-ring, or a washer (not shown) that is constructed from a flexible material can be disposed on the hub 52 to frictionally engage the internal periphery of the supply spool 24. In yet another example, the hub 52 can include a plurality of detents (not shown) radially disposed thereon that can plurality of detents (not shown) on the internal periphery of the supply spool 24.

Figure 6:
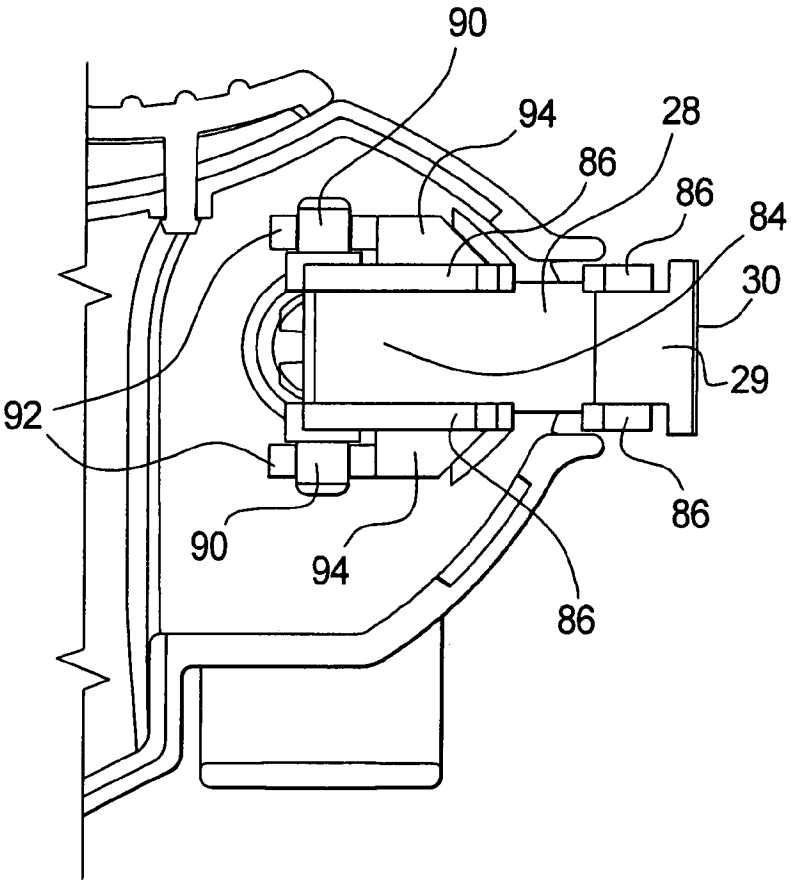
FIG. 6 is a fragmentary view of a transfer tape dispenser constructed in accordance with the teachings of the present disclosure
Figures 8, 9:
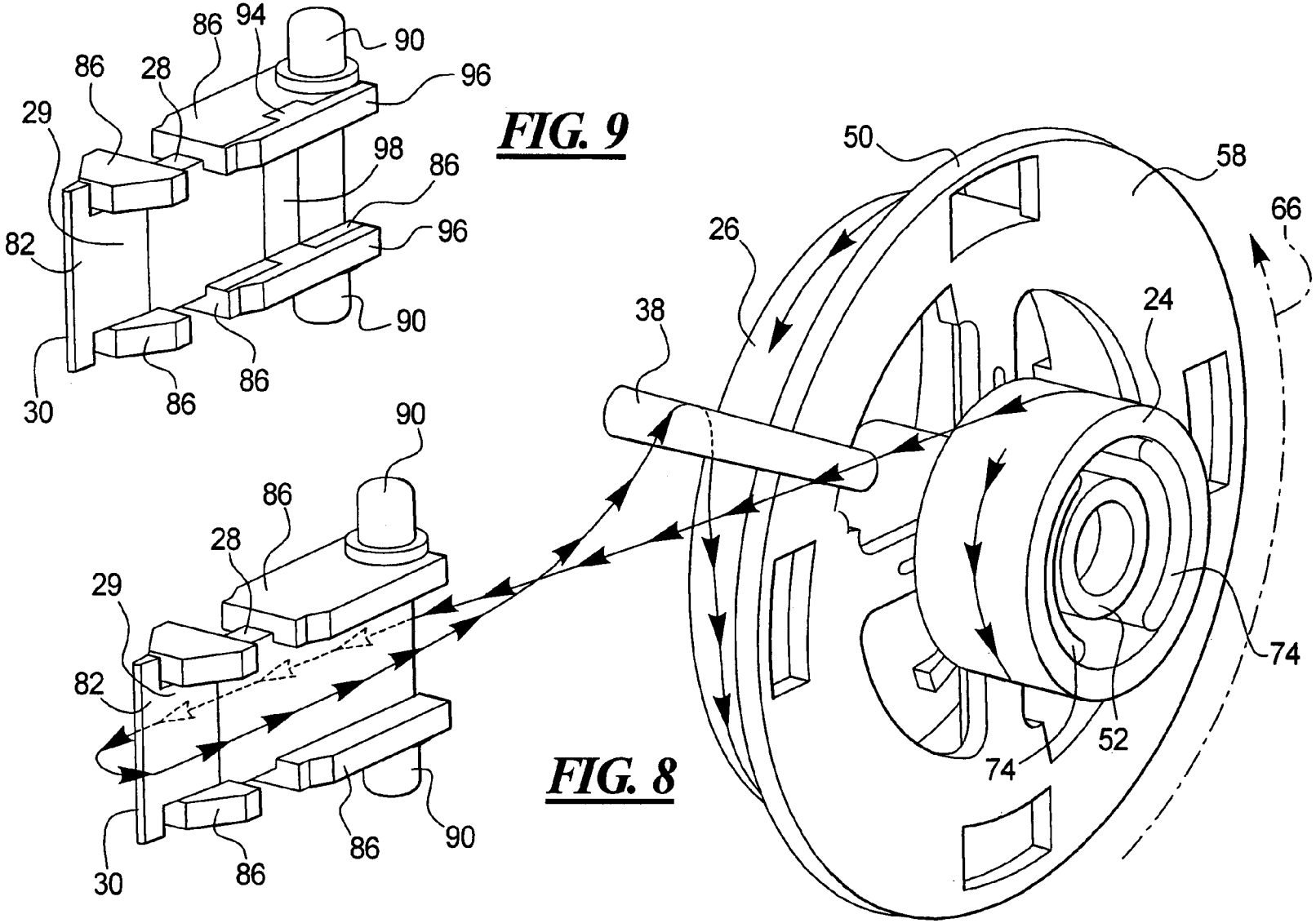
FIG. 8 is an isometric view of a tape path of a transfer tape dispenser constructed in accordance with the teachings of the present disclosure.
FIG. 9 is an isometric view of an alternate example an applicator tip and a cushion body for a transfer tape dispenser constructed in accordance with the teachings of the present disclosure.

Referring to FIGS. 6 and 8, the applicator tip 28 is pivotally mounted inside the case 22. A portion 29 of the applicator tip 28, which includes the application edge 30, protrudes from the case 22 so that the tape 32 can be applied to a surface 42. The protruding portion 29 of the applicator tip 28, however, is wedge-shaped to guide the transfer tape 32 to and from the application edge 30. The transfer tape 32 travels from the supply spool 24 to reach an application side 84 of the applicator tip 28, travels around the application edge 30, and departs a non-application side 82 of the applicator tip 28 for the return spool 26. To maintain the transfer tape 32 on both the application side 84 and the non-application side 82 while traveling on the applicator tip 28, the applicator tip 28 includes guides 86 attached to the sides and bounding the width thereof. The guides 86 also serve to guide the transfer tape 32 and the carrier tape (not shown) to and from the application edge 30, respectively.

As shown in FIG. 8, the applicator tip 28 is generally oriented near 90° relative to the orientation of the transfer tape 32 as it is unwound from the supply spool 24. Accordingly, the tape post 38 directs the transfer tape 32 from the supply spool 24 to the applicator tip 28, and also twists the transfer tape 32 to change its orientation in the path between the supply spool 24 and the applicator tip 28. Also, the tape post 38 directs the transfer tape 32 from the applicator tip 28 to the return spool 26, and also twists the carrier tape (not shown) to change its orientation in the tape path between the applicator tip 28 and the return spool 26. One of ordinary skill in the art will appreciate that the supply tape post 38 can take on a variety of shapes and sizes in order to perform the described functions. In the disclosed example, however, the tape post 38 is a cylindrical rod that is mounted in the case and is generally parallel with the shaft 48.

Referring to FIG. 7, the transfer tape 32 is applied to a surface 42 by a user pressing the application side 84 of the application edge 30 on the surface 42 and moving the transfer tape dispenser 20 in a direction 88. The contact of the transfer tape 32 with the surface 42 at the application edge 30, combined with the movement of the transfer tape dispenser 20 in the direction 88, causes the transfer tape 32 to be pulled from the supply spool 24. Meanwhile, the contact of the application edge 30 with the surface 42 causes the correction tape layer (not shown) of the transfer tape 32 to adhere to the surface 42 at the application edge 30. Because the return spool 26 rotates with the drive wheel 50, the carrier tape (not shown) is pulled by the return spool 26 and collected windingly thereon. Thus, moving the transfer tape dispenser 20 in the direction 88 applies the correction tape layer (not shown) and masks a portion of the surface 42 along the direction 88.

The applicator tip 28 includes a pivot shaft 90 that is pivotally mounted in the case 22 to provide pivoting of the applicator tip 28 at the application edge 30 when being applied to a surface 42. The pivot shaft 90 is parallel with the application edge 30 and is pivotally mounted in a pair Of forks 92 that protrude from the case 22. Accordingly, each end of the pivot shaft 90 pivots inside a corresponding fork 92 to provide pivoting of the applicator tip 28.

The pivoting of the applicator tip 28 is limited and cushioned by a cushion body 94 disposed between the applicator tip 28 and the first side 47 of the case 22. When the application edge 30 is pressed on a surface 42, the applicator tip 28 pivots in a direction 93 as shown in FIG. 7. When the applicator tip 28 pivots from a rest position, the guides 86 of the applicator tip 28 contact the cushion body 94, thus allowing the carrier tape to pass between the cushion body 94 and the non-application side 82 of the applicator tip 28. The pivoting of the applicator tip 28 from a rest position to an application position against the cushion body 94 causes the guides 86 to compresses the cushion body 94, which in turn reacts with a force that biases the applicator tip 28 back to the rest position. As the pivoting increases, the cushion body 94 is compressed further, which causes the force in the cushion 94 to also increase. Accordingly, a user can intuitively sense and determine how hard the application edge 30 can be pressed on a surface 42 for uniform application of the correction tape layer (not shown).

The cushion body 94 also provides cushioned pivoting of the applicator tip 28 when the application edge 30 is being applied to an uneven surface. Furthermore, the cushioned pivoting of the applicator tip 28 can compensate for any misalignment between the application edge 30 and a surface 42. One of ordinary skill in the art will readily appreciate that the cushion body 94 may operate like a spring, a dampener or both. The cushion body 94 is a resilient body that when pressed in a direction provides a reaction force in an opposite direction.

Referring to FIG. 9, the cushion body 94 and the applicator tip 28 can be co-molded during manufacturing. Accordingly, the cushion body 94 is in one piece and includes a pair of cushion body sides 96 that are co-molded on the guides 86 and connected by a bridge 98. When co-molding the cushion body 94 with the applicator tip 28, the bridge 98 fits in a correspondingly sized indentation on the non-application side 82 of the applicator tip 28 so as to be positioned flush with the non-application side 82.

The cushion body 94 may be connected to the applicator tip 28 by, for example, being co-molded with the applicator tip 28, as described above. The cushion body 94 may also be a discrete cushion body that is disposed between the applicator tip 28 and the case 22 without being connected to either the applicator tip 28 or the case 22. The cushion body 94 may also be connected to the case 22 without being connected to the applicator tip 28. However, the cushion body 94 is constructed from a different material than the applicator tip 28 and the case 22. In the disclosed example, the cushion body 94 is constructed as a one-piece elastomer body. The cushion body 94 is also shaped to fit between the applicator tip 28 and the case 22. Furthermore, one of ordinary skill in the art will appreciate that the cushion body 94 and the applicator tip 28 can be co manufactured by, for example, an injection molding process. Similarly, the cushion body 94 and the first side 47 of the case 22 can be co manufactured by, for example, an injection molding process.

Although certain apparatus constructed in accordance with the teachings of the invention have been described herein, the scope of coverage of this patent is not limited thereto. On the contrary, this patent covers all embodiments of the teachings of the invention fairly falling within the scope of the appended claims either literally or under the doctrine of equivalents.

What is claimed is:

1. A transfer tape dispenser comprising:

a case;

a supply spool rotationally mounted in the case and adapted to receive a supply of tape having an application layer and a carrier tape;

a return spool rotationally mounted in the case and adapted to collect the carrier tape;

a substantially rigid applicator tip pivotally mounted in the case and disposed in a path of the tape between the supply spool and the return spool, the applicator tip including a pivot shaft having a pivot axis disposed parallel to an application edge of the applicator tip, the applicator tip pivotable between a rest position and at least an application position; and a cushion body disposed in the case and adapted to bias the applicator tip toward the rest position from the application position.

2. A transfer tape dispenser according to claim 1, wherein the cushion body is a discrete cushion body disposed in the case and adapted to bias the applicator tip to the rest position from the application position.

3. A transfer tape dispenser according to claim 1, wherein the cushion body is co-molded with the applicator tip.

4. A transfer tape dispenser according to claim 1, wherein the cushion body is constructed from a different material than an applicator tip material and a case material.

5. A transfer tape dispenser according to claim 1, wherein the cushion body is constructed with an elastomer.

6. A transfer tape dispenser according to claim 1, wherein the cushion body is independent and separate from the case and the applicator tip and disposed between the applicator tip and an interior surface of the case.

7. A transfer tape dispenser according to claim 1, further comprising a slip clutch adapted to slippably couple the supply spool and the return spool.

8. A transfer tape dispenser according to claim 1, wherein the applicator tip includes an application edge and a plurality of guides, wherein the plurality of guides are adapted to guide the tape to and from the application edge.

9. A transfer tape dispenser according to claim 1, comprising a drive wheel rotationally mounted in the case, wherein the supply spool and the return spool are disposed on the drive wheel.

10. A transfer tape dispenser according to claim 9, further comprising a slip clutch adapted to slippably couple the supply spool and the return spool, wherein the slip clutch is adapted to slippably couple the supply spool to the drive wheel.

11. A transfer tape dispenser according to claim 9, wherein the return spool is integral with the drive wheel.

12. A transfer tape dispenser according to claim 9, wherein the drive wheel includes a plurality of tabs radially disposed thereon and adapted to engage a plurality of detents radially disposed on an interior of the case to prevent the wheel from rotating in a non-dispensing direction.

13. A transfer tape dispenser according to claim 9, wherein the slip clutch includes a plurality of arcuate shoes coupled to a hub projecting from the wheel, and wherein the plurality of arcuate shoes frictionally engage an internal periphery of the supply spool.

14. A transfer tape dispenser according to claim 13, wherein each arcuate shoe includes ridges projecting from an outer surface thereof, and wherein the ridges frictionally engage the internal periphery of the supply spool.

15. A transfer tape dispenser according to claim 1, wherein the case includes at least a tape post adapted to guide the tape from the supply spool to the applicator tip and from the applicator tip to the return spool.

16. A transfer tape dispenser according to claim 1, wherein an exterior of the case includes a plurality of grip pads.

17. A transfer tape dispenser according to claim 1, further comprising an applicator tip protector pivotally attached to an exterior of the case and adapted to pivot between an open position wherein the applicator tip is uncovered and a closed position wherein the applicator tip is covered.

18. A transfer tape dispenser according to claim 1, wherein the supply spool comprises a supply spool axis and the application edge of the applicator tip is oriented perpendicular to the supply spool axis.

19. A transfer tape dispenser comprising:

a case;

a drive wheel rotatably mounted in the case and including a supply side and a return side;

a supply spool rotationally mounted on the supply side of the wheel adapted to receive a supply of tape having an application layer and a carrier tape;

a return spool disposed on the return side of the wheel and adapted to collect the carrier tape;

a substantially rigid applicator tip pivotally mounted in the case and pivotable about a pivot axis fixed parallel relative to an edge of the applicator tip, the applicator tip disposed in a path of the tape between the supply spool and the return spool, the applicator tip adapted to pivot relative to the case about the pivot axis between a rest position and at least an application position;

a cushion body disposed in the case between the applicator tip and an interior surface of the case, wherein the pivoting of the applicator tip to the application position is resiliently opposed by the cushion body; and a slip clutch having a plurality of projections attached to the supply side of the drive wheel, the projections adapted to transfer rotation of the drive wheel to the supply spool and to provide slippable rotation of the supply spool relative to the rotation of the return spool.

20. A transfer tape dispenser according to claim 19, wherein the cushion body is a discrete cushion body disposed in the case and adapted to bias the applicator tip to the rest position from the application position.

21. A transfer tape dispenser according to claim 19, wherein the cushion body is co-molded with the applicator tip.

22. A transfer tape dispenser according to claim 17, wherein the cushion body is constructed from a different material than an applicator tip material and a case material.

23. A transfer tape dispenser according to claim 19, wherein the applicator tip includes an application edge and a plurality of guides, the plurality of guides adapted to guide the tape to and from the application edge.

24. A transfer tape dispenser according to claim 19, wherein the return spool is integral with the drive wheel.

25. A transfer tape dispenser according to claim 19, wherein the drive wheel includes a plurality of tabs radially disposed thereon and adapted to engage a plurality of detents radially disposed on an interior of the case to prevent the wheel from rotating in a non-dispensing direction.

26. A transfer tape dispenser according to claim 19, wherein the case includes at least one tape post adapted to guide the tape from the supply spool to the applicator tip and from the applicator tip to the return spool.

27. A transfer tape dispenser according to claim 19, wherein the cushion body is constructed with an elastomer.

28. A transfer tape dispenser according to claim 19, wherein the cushion body is independent and separate from the case and the applicator tip.

29. A transfer tape dispenser according to claim 19, wherein an exterior of the case includes a plurality of grip pads.

30. A transfer tape dispenser according to claim 19, further comprising an applicator tip protector pivotally attached to an exterior of the case and adapted to pivot between an open position wherein the applicator tip is uncovered to a closed position wherein the applicator tip is covered.

31. A transfer tape dispenser according to claim 19, wherein the supply spool comprises a supply spool axis and the application edge of the applicator tip is oriented perpendicular to the supply spool axis.

* * * * *